United States Patent [19]

Anderson

[11] Patent Number: 4,546,902

[45] Date of Patent: Oct. 15, 1985

[54] APPARATUS FOR CONTROLLING THE RATE OF FLUENT MATERIAL

[76] Inventor: James Y. Anderson, 1838 Cliffhill Dr., Monterey Park, Calif. 91754

[21] Appl. No.: 484,452

[22] Filed: Apr. 13, 1983

Related U.S. Application Data

[62] Division of Ser. No. 317,383, Nov. 2, 1981, Pat. No. 4,411,935.

[51] Int. Cl.[4] ..... B67D 5/56; B67D 3/00

[52] U.S. Cl. ..... 222/129.2; 222/482; 222/547; 239/85; 239/124; 406/144

[58] Field of Search ..... 222/630, 482, 547, 129.2, 222/478, 481, 564; 239/85, 654, 347, 348, 590, 124, 376, 377, 379; 406/144, 93, 84, 154

[56] References Cited

U.S. PATENT DOCUMENTS

| | | | |
|---|---|---|---|
| 1,818,367 | 8/1931 | Wallace | 406/154 |
| 2,233,304 | 2/1941 | Bleakley | 239/428 |
| 2,671,689 | 3/1954 | Wett | 239/85 |
| 2,787,497 | 4/1957 | Kough | 239/290 |
| 2,957,630 | 10/1960 | Lamb | 239/85 |
| 3,111,267 | 11/1963 | Shepard et al. | 239/85 |
| 3,191,869 | 6/1965 | Gilmour | 239/348 |
| 3,281,078 | 10/1966 | Cape | 239/570 |
| 3,352,492 | 11/1967 | Cape | 239/85 |
| 3,404,838 | 10/1968 | Hawk, Sr. | 239/85 |
| 3,415,450 | 12/1968 | Hawk, Sr. | 239/85 |
| 3,432,208 | 3/1969 | Hill et al. | 406/93 |
| 3,436,019 | 4/1969 | Hawk, Sr. | 239/85 |
| 3,504,945 | 4/1970 | Leibundgut et al. | 406/144 |
| 3,620,454 | 11/1971 | Broderick et al. | 239/79 |
| 3,995,811 | 12/1976 | Broderick et al. | 239/85 |

*Primary Examiner*—F. J. Bartuska
*Assistant Examiner*—Andrew Jones
*Attorney, Agent, or Firm*—Sellers and Brace

[57] ABSTRACT

Provided by this invention is an improved apparatus for controlling the rate of flow of fluent material by aspiration into a stream of pressurized gas by regulating the gas pressure downstream from the point of admission of the fluent material thereinto independently of the gas pressure at its source. One regulator regulates the gas pressure and velocity prevailing in a gas and fluent material mixing chamber downstream from a fluent material aspirator and the other regulator regulates the gas pressure closely adjacent the downstream end of the fluent material aspirator. Each regulator can be adjusted to vary the flow of fluent material into the gas stream without need for varying gas flow conditions upstream from the fluent material aspirator.

12 Claims, 5 Drawing Figures

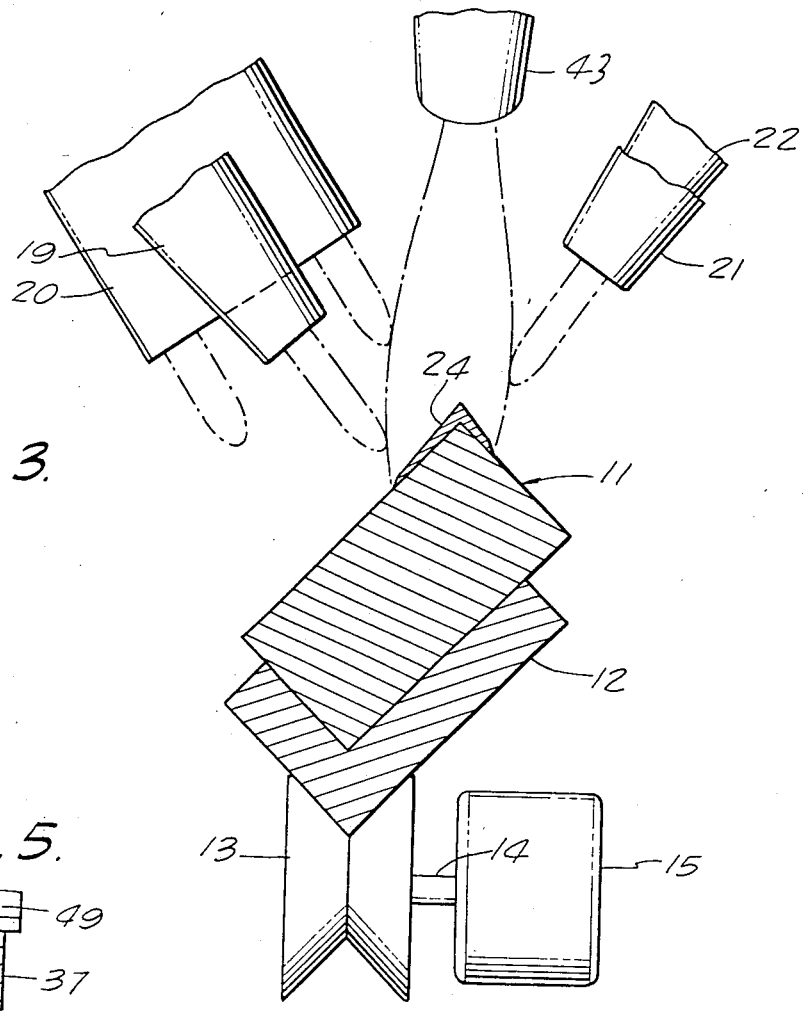
FIG. 3.
FIG. 5.
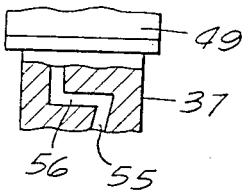
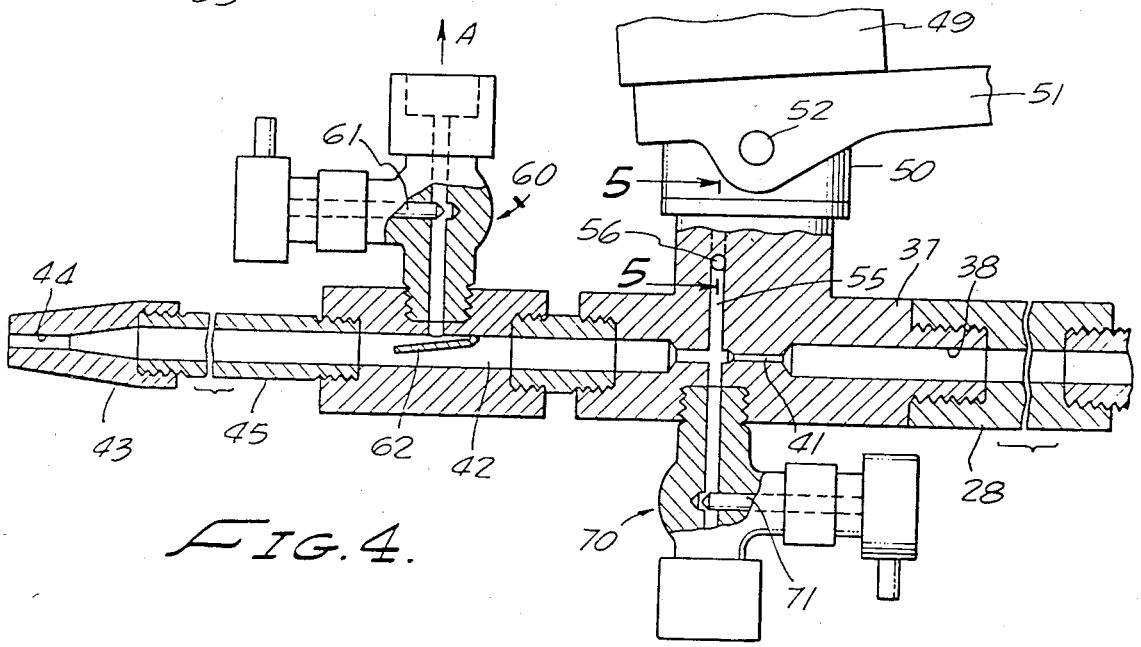
FIG. 4.

APPARATUS FOR CONTROLLING THE RATE OF FLUENT MATERIAL

This application is a division of my copending application Ser. No. 06/317,383 filed Nov. 2, 1981, entitled Powder Flame Spraying Apparatus and Method, now U.S. Pat. No. 4,411,935 granted Oct. 25, 1983.

This invention relates to apparatus for hardfacing metal, and more particularly to an improved powder flame spraying apparatus and method of increased efficiency and effectiveness and embodying numerous novel features.

BACKGROUND OF THE INVENTION

Powder flame spraying apparatus, and particularly equipment designed to apply a layer of hardfacing to metal, dates back many decades. Designers have evolved many variations of high temperature torch equipment for heating a metal surface to a semi-molten condition and feeding abrasion-resistant metal on to such a surface to form a layer of hardfacing. Prior proposals most pertinent to the present invention are disclosed in United States patents to Bleakley Nos. 2,233,304; Wett 2,671,689; Kough 2,787,497; Lamb 2,957,630; Shepherd et al 3,111,267; Cape 3,281,078; Cape 3,352,492; Hawk Sr. 3,404,838; Hawk Sr. 3,415,450; Hawk Sr. 3,436,019; Broderick et al 3,620,454; and Broderick et al 3,995,811.

Each of these patents show means for delivering powder from a reservoir by gravity past a manually operated valve for regulating powder flow. In some of these designs the powder flows into a pressurized gas which discharges the powder and gas mixture into the fuel mixture en route to the burner nozzle or nozzles. Such arrangements are shown in Bleakley Nos. 2,233,304; Wett 2,671, 689 and Hawk Sr. 3,415,450. Others such as Cough 2,787,497; Cape 3,352,492; Broderick et al 3,620,454 and 3,995,811 deliver the powder by gravity directly into the flame jets themselves. However, the remainder of the first listed patents disclose torches in which the powder flows by gravity without a conveying gas stream directly into the fuel mixture en route to the torch flame.

Each of these prior powder delivery systems is subject to serious shortcomings and disadvantages because of the inadequate and inefficient means provided for controlling the quantity or rate of powder flow, the flow being dependent on the operator's manipulation of the flow control means and his guesstimate of the amount of powder flowing at any given time as he manually holds the flow control valve open against a valve closing spring. Additionally the rate of powder flow when mixed with fuel flowing to the torch nozzle varies with fuel flow as adjusted by the operator thereby requiring further guesstimate of the powder valve adjustment.

Another serious shortcoming of prior equipment is the lack of any means for pre-heating the metal to be coated in advance of and prior to the delivery of the powder to the preheated area. In consequence, portions of the powder impinge upon areas of the metal not heated to fusion temperature with resulting loss of very expensive powder.

It is well known that all oxy-acetylene torches, or the like, are typically subject to "backfire" from various causes as, for example, reduced fuel line pressure, accidental obstruction of the nozzle outlet, or operating the torch too close to the workpiece. In consequence, the flame propagation recedes back into the fuel passage leading to the nozzle. This usually extinguishes the torch, accompanied by a disturbing sharp report.

If the torch is being used to feed powder in a hardfacing operation wherein the powder flows by gravity into the nozzle mixing chamber, the backfire is not only accompanied by a disturbing report but can cause an explosion extremely hazardous to both the equipment and the operator. This is because the backfire flame can extend into the powder reservoir causing serious increases in pressure, a shut down in operations, the loss of valuable powder, the repair or replacement of damaged components and severe injuries to the operator.

SUMMARY OF THE INVENTION

This invention has been designed to obviate the serious shortcomings and disadvantages of prior powder flame spraying equipment and to provide a greatly improved method and means for applying hardfacing in a foolproof manner under precise control with negligible loss of powder and without harmful results due to backfire. The invention is characterized in particular by its outstanding control of powder deposit, the negligible loss of powder, and the absence of smoke typically present when using prior hardfacing equipment. The hardfacing powder is distributed to a plurality of heating torches in a stream of inert gas entirely independently of fuel flow. These torches include a preheating torch and a plurality of converging final heating torches into the flame envelopes of which the unheated powder is conveyed by pressurized inert gas operable to aspirate powder flow at a rate easily and precisely varied between minimum and maximum entirely independently of fuel flow. Preferably powder flow is controlled by either one or cojointly by two adjustable venting devices located in the gas conveying line downstream from the powder aspirator. The gravity powder feed is so arranged as to be dependent upon and governed by the operation of the powder aspirator. The pressure and volume of inert gas entering the aspirator remains substantially constant but the downstream gas pressure can be easily and accurately regulated by venting variable quantities of air into the gas line adjacent the aspirator outlet and/or by venting quantities of gas to the atmosphere downstream from the aspirator thereby to vary the flow rate of powder between maximum and minimum. Adjustment of the powder flow regulators also can vary the volume and velocity of powder-laden gas jetted into the envelopes of the final heater flames.

The use of a preheater in advance of properly adjusted final heating torches provides assurance that the powder is dispensed onto an uncoated area of the workpiece previously brought very substantially toward a metal fusing condition by the preheater torch. Owing to this fact and to the low velocity delivery of powder into the converging flame envelopes of the final heaters, the powder is confined strictly to an area heated to fusion temperature under conditions favorable to the instant fusing of virtually all the hardfacing powder directly to the workpiece upon contact therewith.

Should backfire occur it is confined to the mixing chamber leading to one or more of the several torches and is completely isolated from the powder supply system. Consequently, there is no risk of an explosion or harm to the operator or the equipment. Moreover the system operates without manual manipulation and merely involves the usual adjustment of the fuel supply controls, the opening of the powder cutoff valve and noting whether the previous setting of the two gas venting regulators provide a desired flow of powder suspended in gas flowing in an optimum velocity and volume.

Accordingly, it is a primary object of this invention to provide an improved powder flame spraying apparatus and method for applying hardfacing to metal.

Another object of the invention is the provision of a unique powder flame spraying technique utilizing a plurality of heating flames including both pre-heater and final heater flames and having provision for introducing the hardfacing powder into merging portions of the final heater flames in a stream of noncombustible gas.

Another object of the invention is the provision of improved technique for utilizing a pressurized inert gas to aspirate powder from a supply source and including means for regulating powder flow by regulating the gas pressure on the outlet side of a powder aspirator.

Another object of the invention is the provision of an improved method and apparatus for supplying powder to metal being coated with hardfacing independently of fuel flow to the heating flames for the metal undergoing hardfacing.

Another object of the invention is the provision of an improved apparatus and method of utilizing pressurized gas to supply hard facing powder safely to metal undergoing hardfacing at any desired flow rate without risk of an explosion or hazard to the operator or the equipment.

Another object of the invention is the provision of an improved hardfacing technique and equipment providing a hardfacing deposit of crisp definition free of partially fused powder thereon or adjacent thereto.

Another object of the invention is the provision of means for utilizing inert gas to govern the delivery of powder onto an area to be coated with hardfacing and to expedite cooling of the fused deposit.

Another object of the invention is the provision of fluent material feeding equipment operable to control the rate of material flow between maximum and no flow utilizing pressurized gas to aspirate fluent material from a supply source and regulating gas pressure downstream from the aspirator outlet.

Another object of the invention is the provision of pressurized gas to aspirate a flow of hardfacing powder at any of a wide range of flow rates by regulating the admission of gas to the outlet powder aspirator and or regulating the venting of gas to the atmosphere downstream from the powder aspirator outlet.

Another object of the invention is the provision of pressurized inert gas to aspirate flow of powder to flame spraying torch means at a desired rate and to deliver the gas-suspended powder at ambient temperature into the envelope of the torch flame at a readily regulated velocity and in a readily regulated volume.

Another object of the invention is the provision of powder flame spraying apparatus wherein powder flows by gravity toward powder aspirator means via a flow passage effective to interrupt powder flow until and unless the aspirator means is functioning.

Another object of the invention is the provision of powder flame apparatus having gravity responsive powder delivery means provided with a normally closed flow control valve arranged to be held open mechanically until manually released.

Another object of the invention is the provision of powder flame spraying apparatus having powder flow control means including a normally closed cutoff valve in series with powder aspirator means effective to aspirate powder flow at a wide range of flow rates if said cutoff valve is open.

Another object of the invention is the provision of powder flame apparatus having a normally closed on-off powder control valve provided with restraining means to hold it open.

These and other more specific objects will appear upon reading the following specification and claims and upon considering in connection therewith the attached drawing to which they relate.

Referring now to the drawing in which a preferred embodiment of the invention is illustrated:

FIG. 3 is a cross-sectional view on a still larger scale taken along line 3—3 on FIG. 2;

FIG. 4 is a longitudinal cross-sectional view on an enlarged scale taken through the powder feeding subassembly; and FIG. 5 is a fragmentary broken-away view taken along line 5—5 on FIG. 4 showing the dog leg shape of the powder flow passage.

Figure 1:
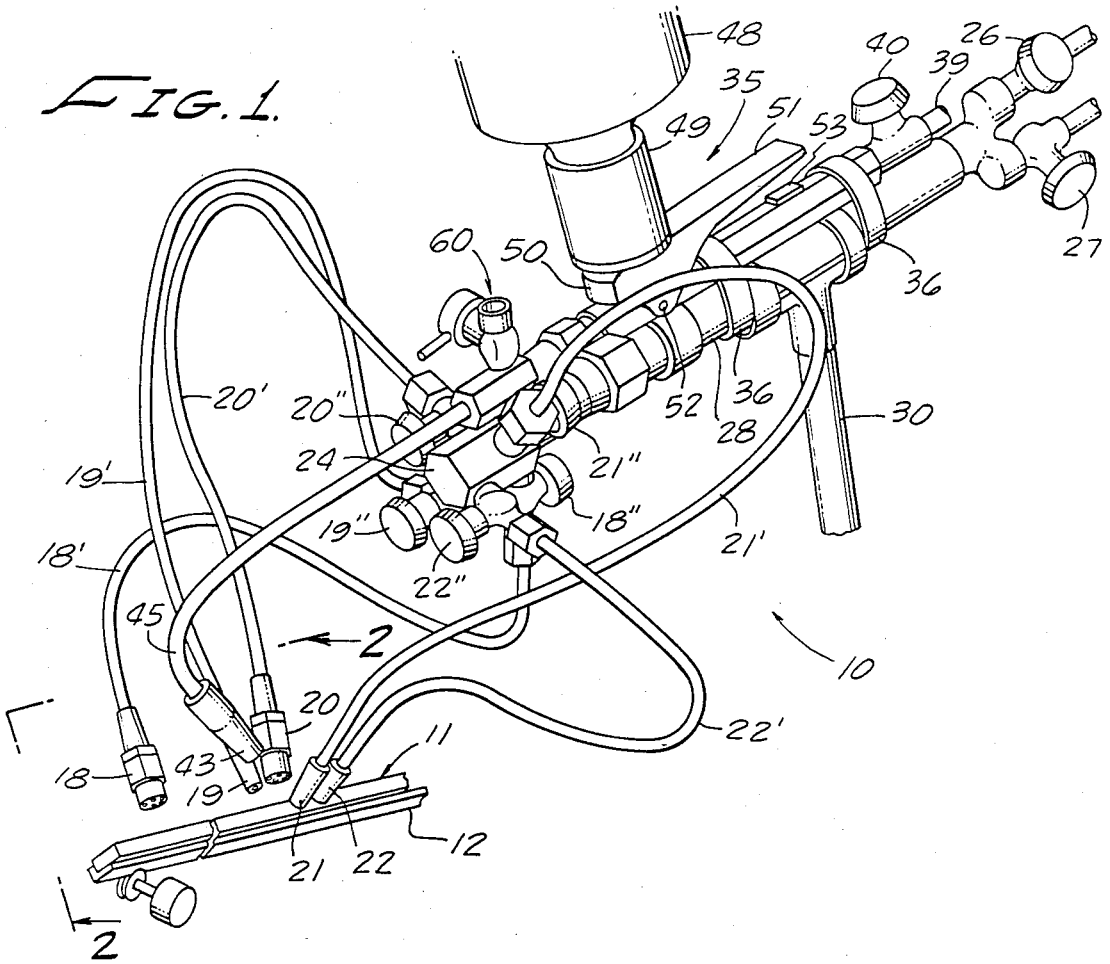
FIG. 1 is a perspective view of the powder flame spraying apparatus usable in practicing the principles of this invention with the various nozzles thereof operatively associated with a workpiece to be hardfaced.

Referring initially and more particularly to FIG. 1, there is shown a typical embodiment of the invention apparatus designated generally 10 in use to hardface the merging surfaces along one corner of a metallic workpiece 11 firmly supported in any suitable conveyor 12. As indicated in FIG. 3, conveyor 12 is supported on a plurality of grooved rollers 13 mounted on a respective shaft 14 and driven in unison by a motor 15.

Workpiece 11 is heated by a plurality of torches including a preheater torch 18 and a group of final heater torches 19, 20, 21 and 22 here shown as arranged in two pairs with the torches of each pair converging toward the area previously heated by preheater torch 18. Each of these torches is connected to the fuel distributing manifold 24 by ductile tubing 18', 19', 20', 21', and 22' through a respective flow control valve 18'', 19'', 20'', 21'' and 22''. The ductile tubing provides convenient means for manipulating the tubing and the associated torch into the optimum heating position with respect to the area of the workpiece to be coated with hardfacing. As herein shown for illustrative purposes, the strip of hardfacing 24 (FIG. 3) is applied astride on corner of the iron workpiece 11 with the wider portion thereof on the upper wider face of the rectangular workpiece. For this reason I find it is expedient to direct the preheater torch flame generally against this face of the workpiece with a portion of the flame impinging on the other face to be coated with the hardfacing. However, it will be understood that the ductile tubing supporting the preheater nozzle facilitates positioning of the preheater as found most advantageous and to provide optimum results attained when the area to be hardfaced is heated partially to powder fusing temperature before being further heated by the final heating torches 19 to 22.

Each of the torches is supplied with suitable fuel, such as oxygen and acetylene, through respective valve control supply lines 26 and 27 leading into a mixing chamber 28 and into a manifold. This entire assembly is rigidly supported in any suitable manner as by a strut or pedestal 30.

The powder feeding and control subassembly designated generally 35 is shown in its essential details in FIG. 4. This subassembly is secured to the mixing chamber 28 for the heating torches by a pair of clamps 36 embracing the main body 37 of subassembly 35. As shown in FIG. 4, the main body 37 is formed of a plurality of fittings threaded to one another in end-to-end alignment to form an inert gas-conveying passage 38 connected by pipe 39 (FIG. 1) to a source of pressurized gas such as carbon dioxide, nitrogen, helium, or the like controlled by a cutoff valve 40. Gas passage 38 includes a venturi having a throat 41 the outlet of which discharges into a gas and powder mixing chamber 42 and a ductile tube 45 terminating in a nozzle 43 having a discharge or outlet port 44. The ductile tubing 45 enables nozzle 43 to be positioned wherever most effective in discharging powder at ambient temperature into the envelopes of the final heating torches 19 to 22 as will be described more fully presently.

Referring more particularly to FIGS. 1 and 4, it will be observed that the hardfacing is stored in a container or reservoir 48 discharging by gravity into a supporting cup 49 for the container attached to the inlet of a powder cutoff valve such as a well known powder pinch off valve 50 normally spring biased to closed position. This valve is movable to open position by an operating handle 51 pivoted to main body 37 by a pin 52. This handle is preferably of magnetic material and is held firmly in open position when pivoted into contact with a permanent magnet 53 (FIG. 1) secured to the main body 37 adjacent the outer end of handle 51.

Powder falling by gravity through valve 50 passes downwardly through passage 55 which includes a horizontally disposed dog leg 56 (FIG. 4) and an outlet position closely adjacent the oulet end of the venturi throat 41. As is best shown in FIG. 5, the dog leg 56 is sufficiently long to prevent powder flow into the gas and powder mixing passage 42 unless aspirated thereinto by gas discharging from venturi throat 41. If it is, the venturi throat is effective to aspirate a flow of powder through the dog leg and the full length of powder passage 55.

The rate of powder flow is widely variable depending on pressure and gas velocity conditions prevailing in mixing chamber 42, as well as at the outlet of venturi 41 or at both locations as will be explained. The volume and velocity of gas issuing from nozzle 43 and the quantity of powder carried therein is dependent upon the adjustment and functioning of either or both of two venting devices 60 and 70, each having one end in communication with mixing chamber 42 and the other end in communication with the atmosphere. As herein shown by way of example, both venting devices 60 and 70 are provided with a respective precision needle valve 61, 71 manually manipulatable to control the flow of gas therepast. Venting device 60 is in communication with mixing chamber 42 appreciably downstream from the outlet of the venturi throat 41 and its inlet is shrouded by a deflector 62 positioned to prevent the entrance of powder thereinto when its needle valve is opened. In this connection, it will be understood and recognized that there is always a superatmospheric pressure condition existing throughout the major length of mixing chamber 42 excepting only the portion thereof surrounding the outlet of the venturi throat 41. Accordingly, if needle valve 61 is open during the operation of the powder delivery system, valve 60 will be effective to vent pressurized gas to the atmosphere as indicated by arrow A in an amount dependent upon the open adjustment of the needle valve. During such venting, deflector 62 will be effective to divert the fast-flowing relatively heavy powder away from the inlet to valve 60 with the result that only gas is vented to the atmosphere.

Venting device 70, as here shown, is identical with venting device 60 and opens into mixing chamber 42 in alignment with the powder supply passage 56 and closely adjacent the outlet of the venturi throat 41. Accordingly, if venting valve 71 is open, the aspirating action provided by venturi throat 41 is effective to aspirate atmosphere air into passage 42 and minimize or attenuate the semi-vacuum condition produced by the venturi throat. It will therefore be appreciated that needle valve 71 provides a very fine and accurate means for regulating the flow of powder produced by the sub-atmospheric condition produced by the flow of inert gas through venturi throat 41. Moreover this wide range control of powder flow is achieved by the admission of a very small amount of atmospheric air. For example, the quantity of powder flow can be controlled between maximum and zero flow by regulating the entry of a relatively insignificant amount of air into chamber 42 in the area adjacent the outlet of venturi 41.

OPERATION

The operation of my hardfacing apparatus will now be described in one of many typical modes of use with the various nozzles adjusted to apply a continuous strip of hardfacing 75 of varying thickness transversely thereof along one merging pair of corner faces of an elongated workpiece 11 supported in the conveyor-driven fixture 12. FIGS. 1 and 3 show the workpiece 11 supported lengthwise of the path of conveyor travel with the corner to be coated uppermost and midway between the pairs of final heater nozzles 19 to 22 and generally directly beneath the powder delivery nozzle 43.

Figure 2:
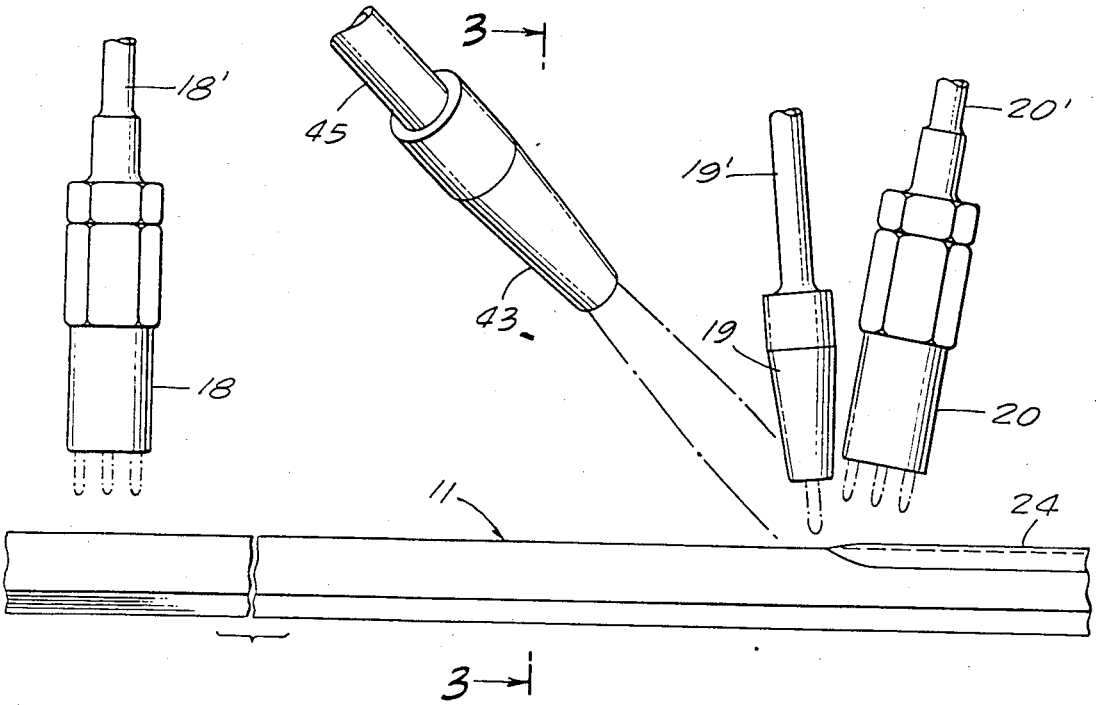
FIG. 2 is a fragmentary view on an enlarged scale taken along the broken line 2—2 on FIG. 1.

Before starting the conveyor motor 15 to advance the workpiece to the right as indicated by arrow C in FIG. 1, the operator makes certain a charge of powder is present in container 48 seated in the powder feed socket 49 and then turns on the valves 26, 27 controlling the supply of oxygen an acetylene to the torch assembly 10. The operator then opens the flow control valves 18'', 19'', 20'', 21'' and 22'' to each of the burner nozzles 18 to 22 as well as the oxyacetylene supply valves 26, 27 and ignites the flames at each of the torches. The various valves are then adjusted to provide the precise flame envelopes at each of the preheater and final heater nozzles necessary to heat the area of the workpiece in the path of the powder dispensed from nozzle 43 to a semi-molten condition. Excellent results are achieved in applying the strip of hardfacing 24 (FIG. 4) to a steel workpiece 11 by using heater 18 to preheat the workpiece to 900° F. and by using heater 19 to 22 to increase the temperature to about 2,000° F. as the powder impinges thereon. FIGS. 2 and 3 do not illustrate the flame envelopes but indicate by dot and dash lines the general size and position of the various flame cones relative to the surface undergoing heating thereby. As is well known by persons skilled in this art, the nature and position of the flame cones is highly significant and important.

The torch flames having been appropriately adjusted for optimum heating effectiveness, the operator opens valve 40 controlling the flow of pressurized inert gas into the powder delivering subassembly 35. Typically, this gas flows past valve 40 at a pressure substantially lower than that existing in the fuel delivery passages and typically at a pressure in the range of 5 to 6 psi. The venturi throat 41 of the powder aspirator in cooperation with the size of nozzle orifice 44 very substantially reduces the inert gas pressure to a valve typically lying between 1 and 1.5 psi where the orifice 44 of nozzle 43 has a diameter of 0.042. However, at this time no powder can flow because the powder cutoff valve 50 is normally closed by spring means not shown.

The apparatus is now in readiness to apply hardfacing to workpiece 11 as soon as the operator opens powder valve 50 and supplies the power to the workpiece conveyor to advance the workpiece to the right as viewed in FIG. 1, as is indicated by arrow C in FIG. 1. The operator initiates powder flow by depressing cutoff valve lever 51 to open this valve which is retained in open position by magnet 53 (FIG. 1). Powder then flows by gravity from the reservoir through passage 55 into the horizontally disposed dog leg 56 from which the powder is aspirated by the gas issuing from the aspirator and venturi orifice 41.

If the needle valve of the two venting valves 60 and 70 are closed, the powder is aspirated at a maximum rate and dispensed from nozzle 43 directly into the merging and converging envelopes of the flames issuing from the final heater nozzles 19 to 22. This powder is quickly heated to a molten condition while entrapped and within the converging envelopes of the final heater flames and is carried thereby directly against the semi-moltened or fused area of the workpiece underlying the final heater nozzles. These flames envelopes not only quickly heat the powder to fusion temperature but they trap it and confine it while aiding in propelling it against the fluent surface of the workpiece. The deposit is quickly cooled to a non-flowing condition by the inert gas used to convey the powder. Furthermore and of particular importance, the deposit of hardfacing is thickest in the area lying midway between the converging final heaters 19 to 22 and here shown as embracing the corner of the workpiece and thins to the crisply and sharply defining opposite lateral feather edges of the strip of hardfacing. This crisp edge is primarily the result of the powder-confining action of the final heater flames and the temperature control achieved by the proper adjustment and positioning of these flames. The edges of the powder deposit lie within the remote sides of the preheater flame envelopes with the result that substantially 100% of the powder is fused to the workpiece and essentially distributed and confined within the areas indicated by the hardfacing layer 24 illustrated in FIG. 3.

If the operator wishes to vary the volume of inert gas flow, the velocity of this jet issuing from nozzle 43, or the quantity of powder issuing from this nozzle, he makes appropriate adjustment of the needle valves of one or both of the venting devices 60 or 70.

Let it be assumed that he wishes to vary the volume and velocity of the gas issuing from nozzle 43. This is accomplished by adjusting the handle of needle valve 61 to vent some of the gas from chamber 42 to the atmosphere. Deflector baffle 62 prevents powder from escaping to the atmosphere through venting device 60 but does permit the desired amount of gas to escape thereby adjusting both the volume and velocity of the inert gas en route to the powder dispensing nozzle 43.

If the operator wishes to reduce the quantity of powder delivered to the workpiece, he adjusts needle valve 71 to an appropriate open position thereby permitting a small amount of atmospheric air to bleed into the subatmospheric pressure conditions prevailing at the outlet end of the aspirator orifice 41. Only a very small amount of air introduced at this point suffices to reduce the semi-vacuum condition existing at this outlet and this reduces the effectiveness of the aspirator to aspirate powder along the dog leg 56 of passage 55.

It will therefore be appreciated that venting device 70 operates as an extremely sensitive and accurate means for varying the quantity and rate of powder delivered to the powder dispensing nozzle 43. If the subatmospheric pressure condition is cancelled at the outlet end of aspirator throat or orifice 41, no powder will be aspirated even though the cutoff valve 50 remains fully open. This is because dog leg 56 lies in a generally horizontal plane with the result that no flow will occur in the absence of suction provided by the aspirating venturi orifice 41.

Accordingly, venting device 70 functions to regulate powder flow from no flow to maximum flow to long as the cutoff valve 50 is held open and pressurized gas is supplied to the aspirator at a uniform rate and pressure, such as 5 to 6 psi. The adjustment of venting device 70 has a negligible effect on the pressure and flow rate of gas in passage 42. However, the adjustment of needle valve 61 in venting device 60 is effective to vary the superatmospheric pressure in passage 42 materially in a range of 1 to 1.5 psi. This change does regulate the flow of powder particularly in the range between maximum flow and about one half of maximum and has a very substantial effect on adjusting the volume and velocity of the jet issuing from powder nozzle 43.

It will be recognized that the operator can adjust the needle valves of either or both of the venting devices 60 and 70 to achieve an extremely wide range of operating results as respects the delivery of powder delivered into and entrained against the semi-molten surface of the workpiece by the converging group of flames issuing from final heater nozzles 19 to 22.

As will be appreciated from the foregoing description of the rigid support for the several torches relative to the workpiece on the conveyor 12, it is unlikely that any backfire will occur. However, if it should, it is confined to the passages supplying fuel to one or more of the torch nozzles. Hence the backfire is completely isolated from the powder-dispensing nozzle and its supply conduit 45 with the result that there is no possibility of an explosion occurring in the powder dispensing subassembly 35.

If the operator wishes to discontinue powder supply without cutting off the flow of inert gas or changing the adjustment of either of the venting devices 60 or 70, he merely lifts handle 51 of cutoff valve 50 from magnet 53 thereby closing the powder cutoff valve. This is highly desirable and a great convenience when adjusting any of the fuel control valves or the position of any of the nozzles relative to the workpiece. Cutoff of the entire apparatus is simply accomplished by closing the inert gas valve 40 and each of the fuel valves 26 and 27 thereby leaving all other valves in their previous preset condition. Operation of the flame spraying device is then resumed in a very simple and expeditious manner by simply reopening gas valve 40 and the two fuel valves 26 and 27 to a preselected normal operating position.

The expression "hard facing" as used in the foregoing description and in the claims will be understood as generic to powder metal flame spraying operations generally, and as including powdered metal compositions suitable for forming a layer to resist erosion and abrasion as well as those powdered metal compositions forming a layer to resist corrosion and attack of the underlying base metal by hostile fluids. Such a protective layer or coating may cover the entire surface of the base metal or only the area in need of protection.

While the particular improved apparatus for controlling the rate of fluent material herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. An improvement in a device for controlling the flow of fluent material suspended in a flowing stream of pressurized gas which comprises:

means providing a supply of fluent material;

flow confining means for conveying a stream of pressurized gas through aspirator means and into a gas and fluent material mixing chamber before dispensing the same through an outlet port;

conduit means constructed and arranged to be responsive to the flow of gas through said aspirator means to conduct fluent material from said supply thereof into said gas stream closely adjacent the downstream end of said aspirator means; and means for regulating the pressure of said gas in said mixing chamber by varying the amount of gas bled from said mixing chamber at a point upstream from said outlet port independently of the gas pressure upstream from said aspirator means thereby to vary the rate of fluent material flow through said conduit means and into said stream of gas.

2. The improvement defined in claim 1 characterized in that said gas pressure regulating means includes means in communication with said gas mixing and fluent material mixing chamber for varying the volume and velocity of gas flow downstream from said aspirating means.

3. The improvement defined in claim 2 characterized in the provision of second pressure regulating means operable to regulate the admission of gas into said gas stream at a point closely downstream from said aspirator means thereby to regulate the flow of fluent material into said gas and fluent material mixing chamber.

4. The improvement defined in claim 2 characterized in that said pressure regulating means is operable to vary the rate of fluent material flow between maximum and any of many different lower rates of flow.

5. The improvement defined in claim 1 characterized in that said fluent material conducting conduit means responsive to the flow of said pressurized gas is arranged for the gravity flow of fluent material into said gas with the exception of a generally horizontally disposed short length thereof whereby the flow of fluent material occurs only in response to a subatmospheric pressure produced in said gas stream downstream from said aspirator means.

6. The improvement defined in claim 5 characterized in the provision of means supporting said supply of fluent material above said aspriator means, and said fluent material conducting means including a dog leg section positioned to interrupt flow therealong except when said aspirator means is operating to aspirate a flow of fluent material into said gas stream.

7. The improvement defined in claim 1 characterized in that said fluent material flow control means includes valve means in an atmospheric vent opening into a superatmospheric pressurized portion of said flow confining means downstream from said aspirating means and manually adjustable to accurately regulate the gas pressure between said fluent material aspirating means and said outlet port.

8. The improvement defined in claim 7 characterized in the provision of means for separating powder from said conveying gas before venting a portion of said gas to the atmosphere.

9. The improvement defined in claim 1 characterized in that said fluent material supply means includes a gravity flow passage having a short non-gravity section effective to block fluent material flow except in response to the operation of said aspirating means.

10. The improvement defined in claim 9 characterized in that said means for regulating the pressure of said pressurized gas between said aspirating means and said outlet port includes needle valve controlled means for venting some of said pressurized gas to the atmosphere thereby to vary the flow of fluent material dispensed from said outlet port.

11. The improvement defined in claim 9 characterized in that said means for regulating said gas pressure is operable to vent atmospheric air into said flow confining means in and closely adjacent the downstream end of said aspirating means thereby to vary the effectiveness of said aspirating means without materially varying the volume of gas flow.

12. The improvement defined in claim 1 characterized in that said means for varying the rate of fluent material flow is operable to regulate the flow of fluent material between zero and maximum flow with minimal, if any, variation in the total flow of said pressurized gas through said aspirator means.

* * * * *